US009188940B2

(12) United States Patent
Fukui et al.

(10) Patent No.: US 9,188,940 B2
(45) Date of Patent: Nov. 17, 2015

(54) DEVELOPING DEVICE, PROCESS CARTRIDGE AND DRUM UNIT

(71) Applicant: CANON KABUSHIKI KAISHA, Tokyo (JP)

(72) Inventors: Yuichi Fukui, Yokosuka (JP); Fumito Nonaka, Mishima (JP); Tachio Kawai, Odawara (JP); Shunsuke Uratani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/338,786

(22) Filed: Jul. 23, 2014

(65) Prior Publication Data

US 2014/0334844 A1 Nov. 13, 2014

Related U.S. Application Data

(62) Division of application No. 13/719,932, filed on Dec. 19, 2012, now Pat. No. 8,909,096.

(30) Foreign Application Priority Data

Dec. 26, 2011 (JP) ..... 2011-283250
Mar. 9, 2012 (JP) ..... 2012-053586

(51) Int. Cl.
*G03G 21/18* (2006.01)
*G03G 21/16* (2006.01)
(Continued)

(52) U.S. Cl.
CPC ..... *G03G 21/1619* (2013.01); *G03G 15/0812* (2013.01); *G03G 21/0029* (2013.01); *G03G 21/1647* (2013.01); *G03G 21/181* (2013.01); *G03G 21/1821* (2013.01)

(58) Field of Classification Search
CPC ..... G03G 21/1647; G03G 15/0812; G03G 21/1619; G03G 21/181; G03G 21/1821; G03G 21/0029
See application file for complete search history.

(56) References Cited

U.S. PATENT DOCUMENTS 5,485,249 A 1/1996 Higeta et al.
5,740,499 A 4/1998 Higeta et al.
(Continued)

FOREIGN PATENT DOCUMENTS

EP 1253485 A2 10/2002
JP H09-138573 A 5/1997
(Continued)

OTHER PUBLICATIONS

International Search Report and Written Opinion in International Patent Application Patent Application No. PCT/JP2012/083763, dated Jul. 1, 2013.

*Primary Examiner* — G. M. Hyder
(74) *Attorney, Agent, or Firm* — Fitzpatrick, Cella, Harper & Scinto

(57) ABSTRACT

A developing device for use with an image forming apparatus, includes: a developer carrying member for carrying a developer; a developer regulating member for regulating an amount of the developer carried on the developer carrying member; a first frame for supporting the developer regulating member; a fixing member for fixing the developer regulating member to the first frame; a second frame mounted to the first frame; and a molded resin portion formed by injecting a melted resin material into a space defined by the first and second frames. The molded resin portion is engaged with a first limiting portion provided as a part of the fixing member and projected into the space and is engaged with a second limiting portion provided as a part of the second frame to connect the first and second frame.

9 Claims, 9 Drawing Sheets

(51) Int. Cl.
*G03G 15/08* (2006.01)
*G03G 21/00* (2006.01)

(56) References Cited

U.S. PATENT DOCUMENTS

| | | | | |
|---|---|---|---|---|
| 5,937,237 | A | 8/1999 | Nonaka et al. | |
| 6,101,348 | A | 8/2000 | Nonaka et al. | |
| 6,246,853 | B1 | 6/2001 | Suzuki et al. | |
| 6,826,380 | B2 | 11/2004 | Karakama et al. | |
| 6,868,243 | B2 | 3/2005 | Watanabe et al. | |
| 6,922,534 | B2 | 7/2005 | Goto et al. | |
| 7,082,276 | B2 | 7/2006 | Karakama et al. | |
| 7,110,703 | B2 | 9/2006 | Uratani et al. | |
| 7,283,765 | B2 | 10/2007 | Uratani et al. | |
| 7,366,439 | B2 | 4/2008 | Anan et al. | |
| 7,865,115 | B2 | 1/2011 | Oguma et al. | |
| 7,933,534 | B2 | 4/2011 | Hoshi et al. | |
| 8,208,830 | B2 | 6/2012 | Uratani et al. | |
| 8,682,211 | B2 | 3/2014 | Hoshi et al. | |
| 8,909,096 | B2 * | 12/2014 | Fukui et al. | 399/111 |
| 2002/0037179 | A1 | 3/2002 | Suzuki et al. | |
| 2005/0232654 | A1 | 10/2005 | Karakama et al. | |
| 2009/0245851 | A1 * | 10/2009 | Hoshi et al. | 399/103 |
| 2010/0278559 | A1 | 11/2010 | Komatsu et al. | |
| 2011/0286762 | A1 | 11/2011 | Hoshi et al. | |
| 2012/0243905 | A1 | 9/2012 | Uratani et al. | |
| 2012/0269540 | A1 | 10/2012 | Kawai et al. | |
| 2013/0022368 | A1 | 1/2013 | Takarada et al. | |
| 2013/0114972 | A1 | 5/2013 | Takarada et al. | |
| 2013/0129378 | A1 | 5/2013 | Hoshi et al. | |
| 2013/0177334 | A1 | 7/2013 | Nonaka et al. | |
| 2014/0093271 | A1 | 4/2014 | Hoshi | |

FOREIGN PATENT DOCUMENTS

| | | | |
|---|---|---|---|
| JP | H09-171341 | A | 6/1997 |
| JP | 2003-236877 | | 8/2003 |
| JP | 2004-078006 | A | 3/2004 |
| JP | 2006-44025 | | 2/2006 |
| WO | 2013/085072 | A1 | 6/2013 |

* cited by examiner (a)

(b)

(a)

(b)

DEVELOPING DEVICE, PROCESS CARTRIDGE AND DRUM UNIT

FIELD OF THE INVENTION AND RELATED ART

The present invention relates to a developing device, a process cartridge and a drum unit which are to be used in an image forming apparatus.

In a conventional electrophotographic image forming apparatus, a process cartridge type in which an electrophotographic photosensitive member and process means acting on the electrophotographic photosensitive member are integrally assembled into a cartridge which is detachably mountable to an image forming apparatus main assembly is employed (Japanese Laid-Open Patent Application (JP-A) 2003-236877 and JP-A 2006-44025). Here, the electrophotographic image forming apparatus forms an image on a recording material by using an electrophotographic image forming process. Examples of the image forming apparatus may include an electrophotographic copying machine, an electrophotographic printer (e.g., an LED printer, a laser beam printer or the like), an electrophotographic facsimile machine, an electrophotographic word processor, and the like.

Further, the process cartridge is prepared by integrally assembling an electrophotographic photosensitive member drum as an image bearing member and, as process means acting on the photosensitive drum, at least a developing roller as a developer carrying member into a cartridge. Further, the developing device is prepared by integrally assembling a developer accommodating portion and the developing roller into a cartridge which is detachably mountable to the image forming apparatus.

Further, the image forming apparatus main assembly is a portion of the image forming apparatus from which the process cartridge and the developing device are removed.

According to this process cartridge type, the maintenance of the apparatus can be performed by a user himself (herself) without relying on a service person, so that operatively was able to be remarkably improved. From such a reason, the process cartridge type has been widely used in the image forming apparatus.

The process cartridge is divided into a developing unit and a photosensitive drum unit. Further, in the developing unit, a developer regulating member for regulating a developer layer on the developing roller is fixed to a developing device frame as a first frame with a screw. Further, a bearing as a second frame for supporting the developing roller is fixed with a screw at two end positions of the first frame with respect to a developing roller axial direction (hereinafter referred to as a longitudinal direction. In this way, the developing roller and the developer regulating member are positioned relative to each other and are integrally disposed.

As a method of fixing the second frame to the first frame, in order to improve space efficiency of a fixing portion, it has been also known that resin bonding is used in place of the use of the screw. In this method, a melted resin material is poured between the first frame and the second frame and then is cooled and solidified, thus fixing the first frame and the second frame (JP-A 2003-236877). Further, also a method in which a projection is provided on the first frame and then the melted resin material is fixed to the projection to more strongly fix the first frame and the second frame has been known (JP-A 2006-44025).

Further, in the photosensitive drum unit, a cleaning member for removing the developer on the portion is fixed to a cleaning (device) frame as the first frame. Further, the bearing as the second frame for supporting the photosensitive drum is fixed to the first frame with the screw at two end positions of the first frame with respect to a photosensitive drum axial direction (which is the same direction as the developing roller axial direction and is hereinafter referred to as a longitudinal direction). Thus, the photosensitive drum and the cleaning member are positioned relative to each other and are integrally disposed.

Also with respect to the photosensitive drum unit, similarly as in the case of the developing unit, the method of fixing the second frame to the first frame by using the resin bonding has been known.

Such a process cartridge is collected and recycled when it reaches the end of its lifetime. In order to recycle the process cartridge, the developing unit is disassembled into respective parts. The disassembled parts are classified every material, thus being recycled and reused. Similarly, also the photosensitive drum unit (photosensitive member unit) is disassembled into respective parts. The disassembled parts are classified every material, thus being recycled and reused.

However, in the above-described methods, there is a need to avoid interference between a fixing space for permitting fixing of a developing blade to the first frame with the screw and a fixing space for permitting fixing of the second frame, for supporting the developing roller, to the first frame and thus there is a need to separately provide these two fixing spaces. Similarly, there is a need to avoid interference between a fixing space for permitting fixing of a cleaning blade to the first frame with the screw and a fixing space for permitting fixing of the second frame, for supporting the photosensitive drum, to the first frame and thus there is a need to separately provide these two fixing spaces. With advanced downsizing of the image forming apparatus and the process cartridge used in the image forming apparatus, in some cases, the provision of the above two fixing spaces added constraints to design for downsizing the process cartridge.

Further, when the process cartridge is disassembled into the respective parts for recycling, with respect to the developing unit, in some cases, there was a need to perform two steps including a step for demounting the second frame for supporting the developing roller from the first frame and a step for demounting the developing blade from the first frame. Further, in the case the resin bonding was used for fixing the second frame, there was a need to perform an operation such that the second frame was cut away from the first frame. Similarly, with respect to the photosensitive drum unit, in some cases, there was a need to perform two steps including a step for demounting the second frame from the first frame and a step for demounting the cleaning blade from the first frame. Further, in the case where the resin bonding was used for fixing the second frame, there was a need to perform an operation such that the second frame was cut away from the first frame.

SUMMARY OF THE INVENTION

A principal object of the present invention is to provide a developing device, a process cartridge and a drum unit which have realized downsizing.

Another object of the present invention is to provide a technique capable of reducing the number of disassembling steps in an image forming apparatus.

According to an aspect of the present invention, there is provided a developing device for use with an image forming apparatus, comprising: a developer carrying member for carrying a developer; a developer regulating member for regulating an amount of the developer carried on the developer carrying member; a first frame for supporting the developer regulating member; a fixing member for fixing the developer regulating member to the first frame; a second frame mounted to the first frame; and a molded resin portion formed by injecting a melted resin material into a space defined by the first frame and the second frame, wherein the molded resin portion is engaged with a first limiting portion provided as a part of the fixing member and projected into the space and is engaged with a second limiting portion provided as a part of the second frame to connect the first frame and the second frame.

According to another aspect of the present invention, there is provided a developing device for use with an image forming apparatus, comprising: a developer carrying member for carrying a developer; a developer regulating member for regulating an amount of the developer carried on the developer carrying member; a first frame for supporting the developer regulating member; a fixing member for fixing the developer regulating member to the first frame; a second frame mounted to the first frame; and a molded resin portion formed by injecting a melted resin material into a space defined by the first frame and the second frame, wherein the molded resin portion is engaged with a first limiting portion provided as a part of the fixing member and projected into the space and is engaged with a second limiting portion provided as a part of the second frame to connect the first frame and the second frame.

According to another aspect of the present invention, there is provided a process cartridge detachably mountable to a main assembly of an image forming apparatus, comprising: a photosensitive drum; a developer carrying member for developing an electrostatic latent image, formed on the photosensitive drum, with a developer carried thereon; a developer regulating member for regulating an amount of the developer carried on the developer carrying member; a first frame for supporting the developer regulating member; a fixing member for fixing the developer regulating member to the first frame; a second frame mounted to the first frame; and a molded resin portion formed by injecting a melted resin material into a space defined by the first frame and the second frame, wherein the molded resin portion is engaged with a first limiting portion provided as a part of the fixing member and projected into the space and is engaged with a second limiting portion provided as a part of the second frame to connect the first frame and the second frame.

According to a further aspect of the present invention, there is provided a process cartridge detachably mountable to a main assembly of an image forming apparatus, comprising: a photosensitive drum; a cleaning member for removing a developer from the photosensitive drum; a first frame for supporting the cleaning member; a fixing member for fixing the cleaning member to the first frame; a second frame mounted to the first frame; and a molded resin portion formed by injecting a melted resin material into a space defined by the first frame and the second frame, wherein the molded resin portion is engaged with a first limiting portion provided as a part of the fixing member and projected into the space and is engaged with a second limiting portion provided as a part of the second frame to connect the first frame and the second frame.

These and other objects, features and advantages of the present invention will become more apparent upon a consideration of the following description of the preferred embodiments of the present invention taken in conjunction with the accompanying drawings.

Figure 8:
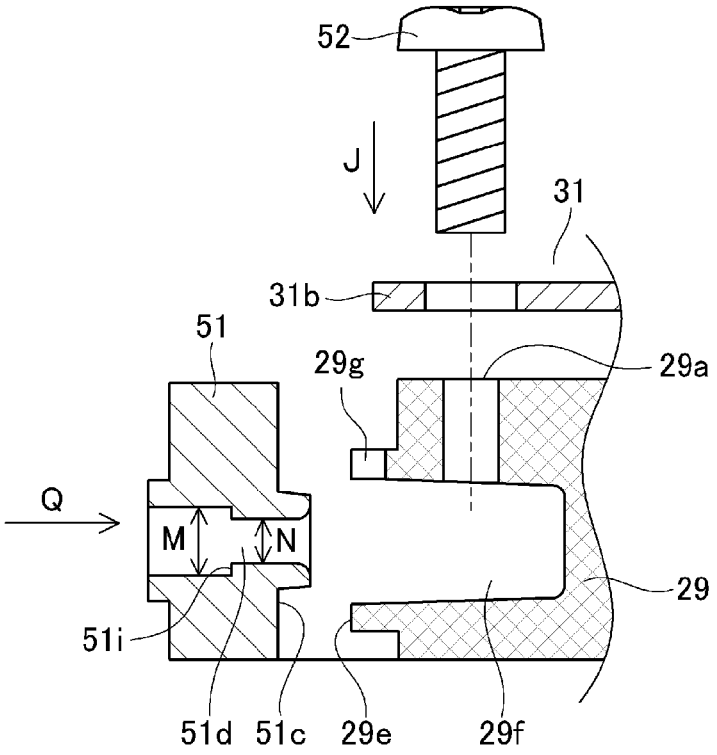
Figure 8:
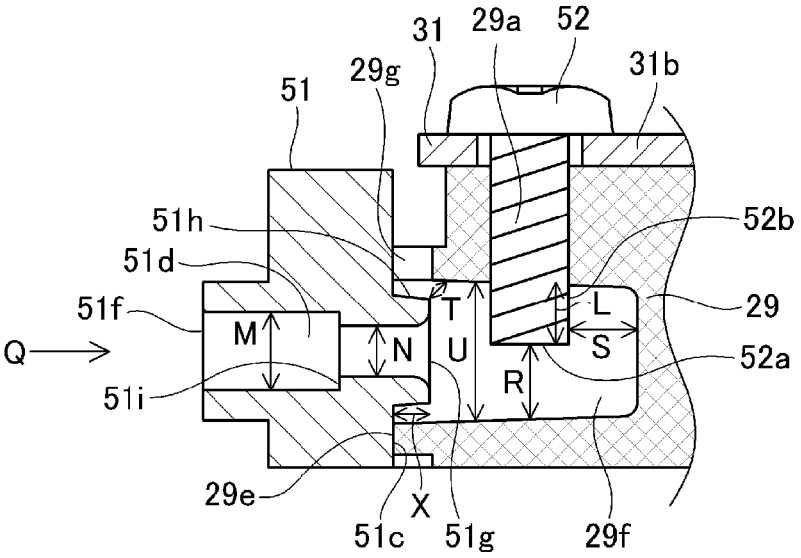

Parts (a) and (b) of FIG. 8 are sectional views for illustrating a fixing method of the developing device frame and the non-driving side bearing in the embodiment of the present invention.

Figure 9:
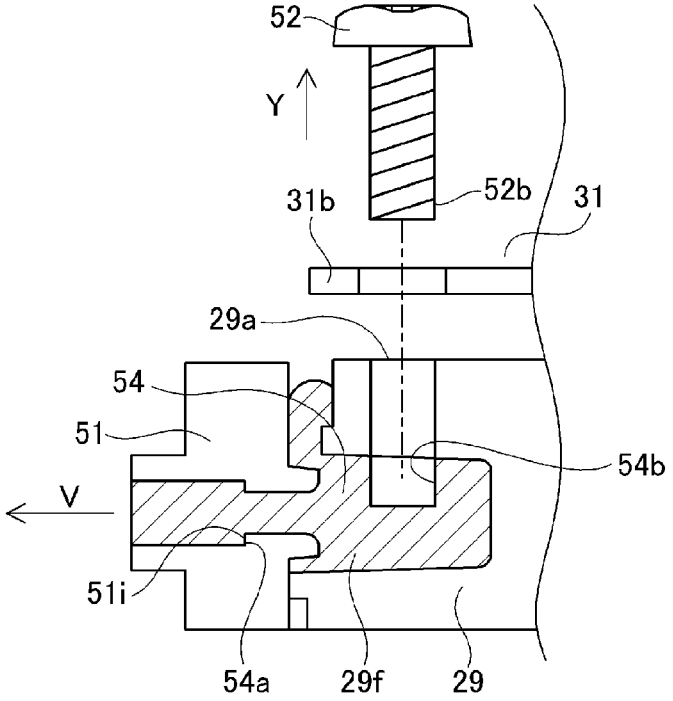
Figure 9:
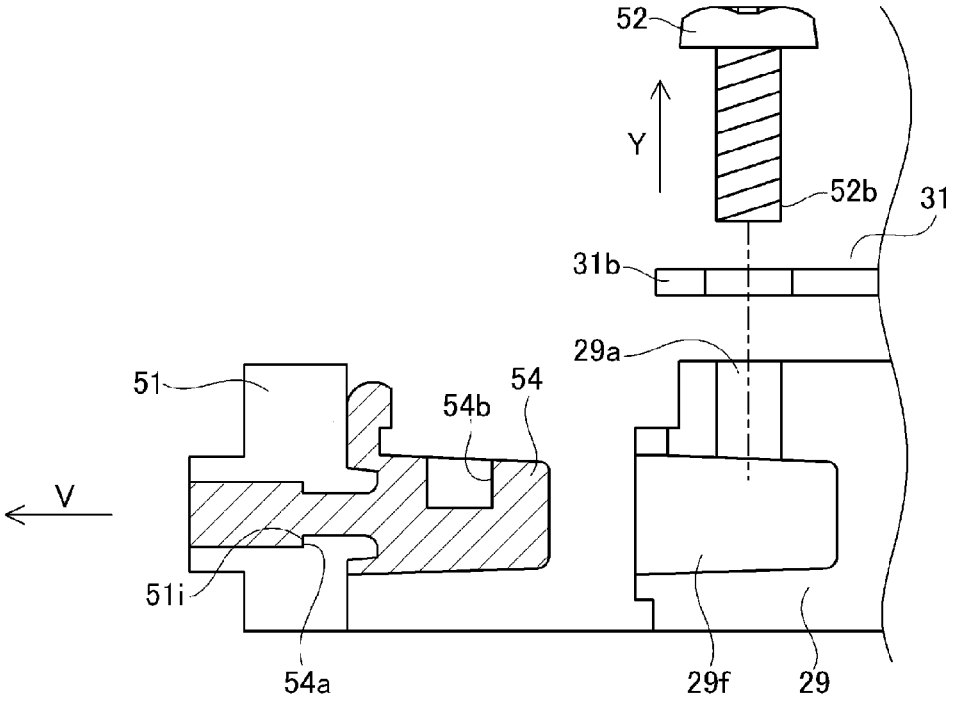

Parts (a) and (b) of FIG. 9 are sectional views for illustrating a disassembling method of the non-driving side bearing from the developing device frame.

Figure 10:
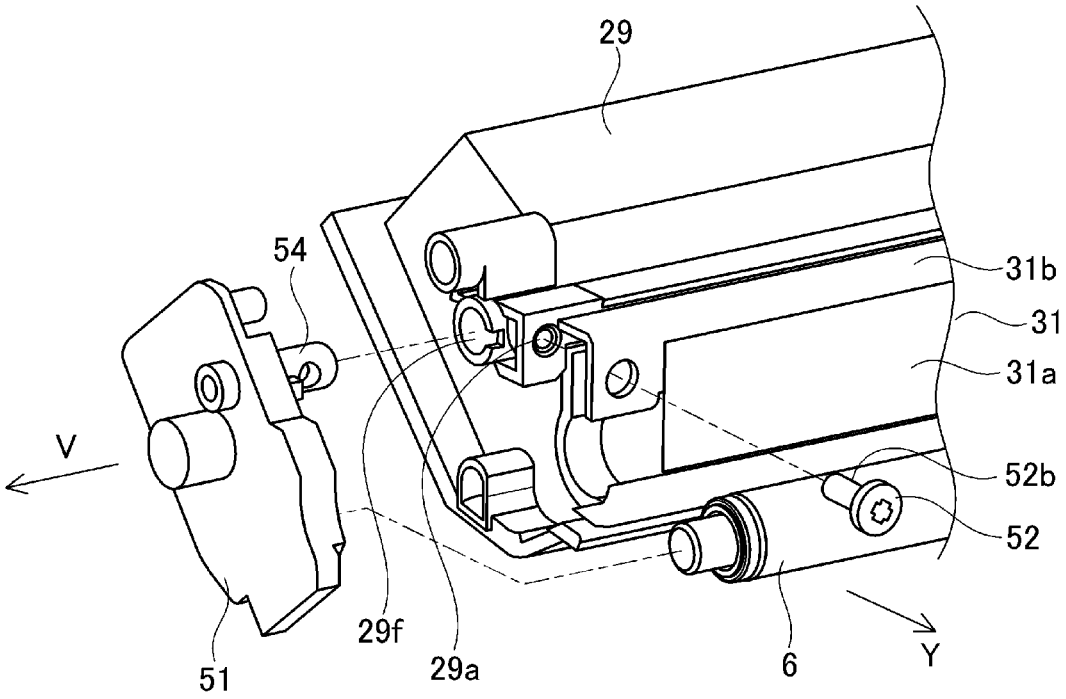

FIG. 10 is a perspective view for illustrating the disassembling method of the non-driving side bearing from the developing device frame.

DESCRIPTION OF THE PREFERRED EMBODIMENTS

With reference to the drawings, embodiments for carrying out the present invention will be described. However, dimensions, materials, shapes and relative arrangements of constituent elements described in the following embodiments should be appropriately modified depending on constitutions and various conditions of a device (apparatus) to which the present invention is applied. That is, the scope of the present invention is not limited to the following embodiments.

(Embodiment 1)

<General Structure of Image Forming Apparatus>

Embodiment 1 of the present invention will be described with reference to the drawings. In the following embodiments, as an image forming apparatus, a full-color image forming apparatus to which four process cartridges are detachably mountable is exemplified.

The number of the process cartridges mounted in the image forming apparatus is not limited to four but may appropriately be set as desired.

For example, in the case of an image forming apparatus for forming a monochromatic image, the number of the process cartridge mounted in the image forming apparatus is one. Further, in the following embodiments, as an example of the image forming apparatus, a printer is exemplified.

Figure 2:
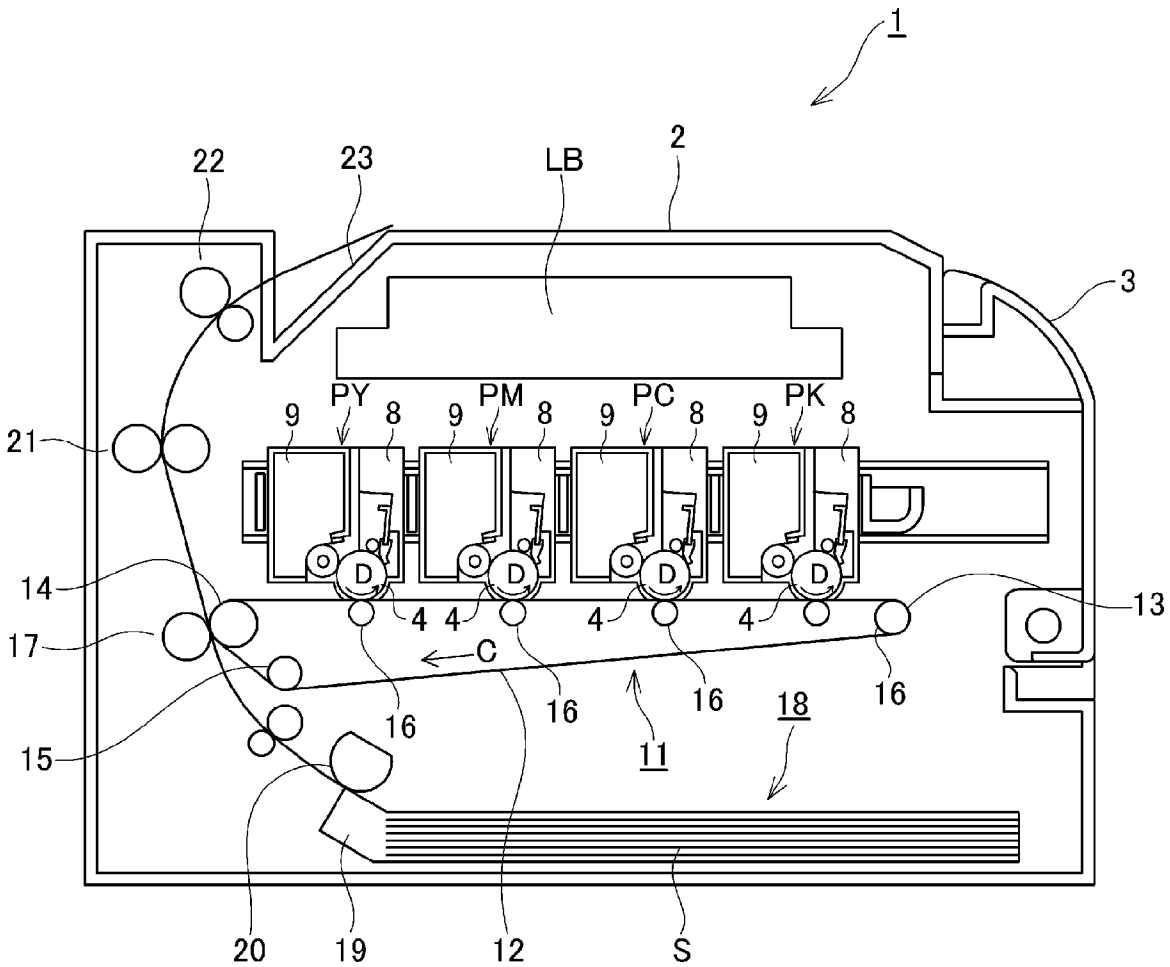
FIG. 2 is a schematic sectional view of an image forming apparatus in the embodiment of the present invention.

FIG. 2 is a schematic sectional view of an image forming apparatus 1 according to this embodiment of the present invention. As shown in FIG. 2, this image forming apparatus 1A is a four color-based full-color laser printer using the electrophotographic image forming process and effects color image formation on a recording material S. The image forming apparatus 1 is of a process cartridge type in which the process cartridge is detachably mountable to an image forming apparatus main assembly 2 and a color image is formed on the recording material S.

Here, with respect to the image forming apparatus 1, the side (surface) on which a front door 3 is provided is referred to as a front side (surface), and a side (surface) opposite to the front side (surface) is referred to as a rear side (surface). The left and right of the apparatus main assembly 1A are those when the apparatus main assembly 1A is viewed from the front side. Further, a right side when the image forming apparatus 1 is viewed from the front surface is referred to as a driving side, and a left side is referred to as a non-driving side. FIG. 2 is a sectional view of the image forming apparatus 1 as seen from the non-driving side, in which the front surface (side) on the drawing is the non-driving side of the image forming apparatus 1, the right side on the drawing is the front surface (side) of the image forming apparatus 1, and the rear side is the driving side of the image forming apparatus 1.

In the image forming apparatus main assembly 2, four process cartridges P (PY, PM, PC, PK) consisting of a first process cartridge PY, a second process cartridge PM, a third process cartridge PC and fourth process cartridge PK are horizontally disposed.

Each of the first to fourth process cartridges P (PY, PM, PC, PK) includes the same electrophotographic image forming process mechanism and contains a developer of a color different from those of developers in other process cartridges. To each of the first to fourth process cartridges P (PY, PM, PC, PK), a rotational driving force is transmitted from a drive outputting portion (not shown) of the image forming apparatus main assembly 2.

Further, to each of the first to fourth process cartridges P (PY, PM, PC, PK), from the image forming apparatus main assembly 2, a bias voltage (charging bias, developing bias or the like) is supplied (not shown).

Figure 3:
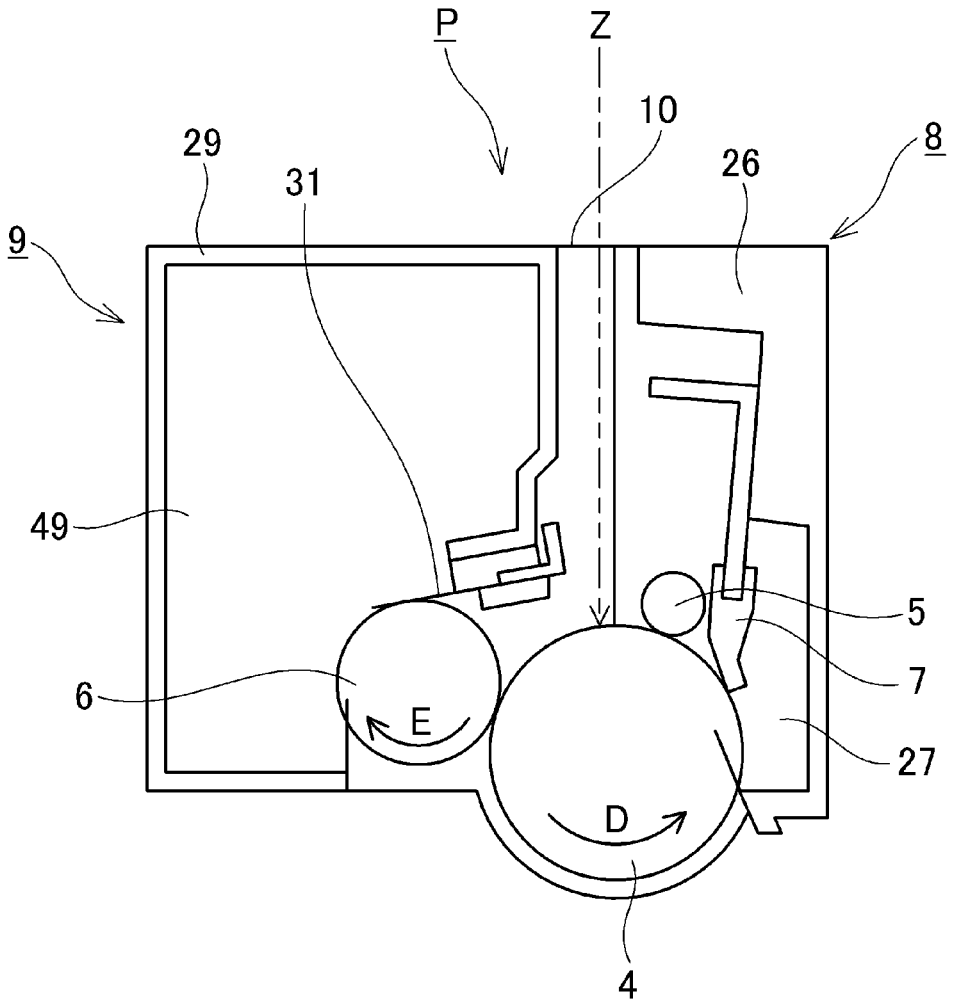
FIG. 3 is a schematic sectional view of a process cartridge in the embodiment of the present invention.

FIG. 3 is a schematic sectional view of the process cartridge P according to this embodiment of the present invention. As shown in FIG. 3, each of the first to fourth process cartridges P (PY, PM, PC, PK) includes a cleaning unit 8 provided with a photosensitive drum 4 and, as process means acting on the photosensitive drum 4, a charging means 5 and a cleaning means. Further, each of the process cartridges P (PY, PM, PC, PK) includes a developing device 9 provided with a developing means for developing an electrostatic latent image on the photosensitive drum 4. The photosensitive drum unit 8 and the developing device 9 are connected with each other. As the charging means, a charging roller 5 is used. As the cleaning means, a cleaning blade (cleaning member) 7 is used. As the developing means, a developing roller 6 is used. A more specific constitution of the process cartridges will be described below.

The first process cartridge PY accommodated the developer of yellow (Y) in its developer accommodating portion 49 of a developing device frame 29 and forms the developer image of yellow on the surface of the photosensitive drum 4. The second process cartridge PM accommodates the developer of magenta (M) in its developer accommodating portion 49 of the developing device frame 29 and forms the developer image of magenta on the surface of the photosensitive drum 4. The process third cartridge PC accommodates the developer of cyan (C) in its developer accommodating portion 49 of the developing device frame 29 and forms the developer image of cyan on the surface of the photosensitive drum 4. The fourth process cartridge PK accommodates the developer of black (K) in its developer accommodating portion 49 of the developing device frame 29 and forms the developer image of black on the surface of the photosensitive drum 4.

Above the first to fourth process cartridges P (PY, PM, PC, PK), a laser scanner unit LB as an exposure means is disposed. This laser scanner unit LB outputs laser light Z correspondingly to image information. Then, the laser light Z passes through an exposure window portion 10 of each process cartridge P, so that the surface of the photosensitive drum 4 is subjected to scanning exposure to the laser light L.

Under the first to fourth process cartridges P (PY, PM, PC, PK), an intermediary transfer belt unit 11 as a transfer member is disposed. This intermediary transfer belt unit 11 includes a driving roller 13, a turn roller 14 and a tension roller 15, and includes a transfer belt 12 extended and stretched by the rollers. The photosensitive drum 4 of each of the first to fourth process cartridges P (PY, PM, PC, PK) is contacted to an upper surface of the transfer belt 12 at its lower surface. A resultant contact portion is a primary transfer portion. Inside the transfer belt 12, primary transfer rollers 16 are disposed opposed to the associated photosensitive drums 4. Oppositely to the turn roller 14, a secondary transfer roller 17 is disposed in contact with the transfer belt 12. A resultant contact portion between the transfer belt 12 and the secondary transfer roller 17 is a secondary transfer portion.

Below the intermediary transfer belt unit 11, a sheet feeding unit 18 is disposed. This sheet feeding unit 18 includes a sheet feeding tray 19 in which sheets of the recording material S are stacked, and includes a sheet feeding roller 20 and the like.

At an upper left portion of the image forming apparatus main assembly 2 in FIG. 2, a fixing unit 21 and a sheet discharging unit 22 are disposed. An upper surface of the image forming apparatus main assembly 2 constitutes a sheet discharge tray 23.

On the recording material S, the developer image is fixed by the fixing means provided to the fixing unit 21, and then the recording material S is discharged onto the discharge tray 23.

[Image Forming Operation]

An operation for forming a full-color image is as follows. The photosensitive drums 4 of the first to fourth process cartridges P (PY, PM, PC, PK) are rotationally driven at a predetermined speed (in an arrow D direction in FIG. 3 and in a counterclockwise direction in FIG. 3. The transfer belt 12 is also rotationally driven in the same direction (arrow C direction in FIG. 2) as the rotational direction of the photosensitive drums 4 (at their contact portions) at a speed corresponding to the speed of the photosensitive drums 4. The laser scanner unit LB is also driven. In synchronism with the drive of the laser scanner unit LB, the surface of the photosensitive drum 4 of each process cartridge P is uniformly charged to a predetermined polarity and a predetermined potential by the charging roller 5. The laser scanner unit LB scans and exposes the surface of each photosensitive drum 4 with the laser light Z depending on an image signal for an associated color. As a result, an electrostatic latent image depending on the image signal for the associated color is formed on the surface of each photosensitive drum 4. The thus formed electrostatic latent image is developed by the developing roller 6 which is rotationally driven (in an arrow E direction in FIG. 3 or in the clockwise direction in FIG. 2) at a predetermined speed.

By the electrophotographic image forming process as described above, on the photosensitive drum 4 of the first process cartridge PY, a yellow developer image corresponding to a yellow component for the full-color image is formed. Then, the developer image is primary-transferred onto the transfer between 12.

Similarly, on the photosensitive drum 4 of the second process cartridge PM, a magenta developer image corresponding to a magenta component for the full-color image is formed.

Then, the developer image is primary-transferred superposedly onto the yellow developer image which has already been transferred on the transfer belt 12.

Similarly, on the photosensitive drum 4 of the third process cartridge PC, a cyan developer image corresponding to a cyan component for the full-color image is formed. Then, the developer image is primary-transferred superposedly onto the yellow and magenta developer images which have already been transferred on the transfer belt 12.

Similarly, on the photosensitive drum 4 of the fourth process cartridge PK, a black developer image corresponding to a black component for the full-color image is formed. Then, the toner image is primary-transferred superposedly onto the yellow, magenta and cyan developer images which have already been transferred on the transfer belt 12.

In this way, unfixed developer images of yellow, magenta, cyan and black for the four color-based full-color image are formed on the transfer belt 12.

On the other hand, with predetermined control timing, sheets of the recording material S are separated and fed one by one. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color developer images superposed on the transfer belt 12 are collectively transferred onto the surface of the recording material S.

[General Structure of Process Cartridge]

FIG. 3 is a sectional view of the process cartridge P in this embodiment.

In this embodiment, the first to fourth process cartridges P (PY, PM, PC, PK) have the same electrophotographic process mechanism but are different from each other in color and filling amount of the accommodated developers.

Each process cartridge P includes the photosensitive drum 4 and the process means acting on the photosensitive drum 4. Examples of the process means may include the charging roller 5 as the charging means for charging the photosensitive drum 4, the developing roller 6, which is a developer carrying member for carrying and conveying the developer, as the developing means for developing the latent image formed on the photosensitive drum 4, and the cleaning blade 7 as a cleaning means for removing a residual developer remaining on the surface of the photosensitive drum (photosensitive member) 4, and the like member. Further, the contact P is divided into the drum unit 8 and the developing device 9 (hereinafter referred to as a developing unit 9).

Figure 5:
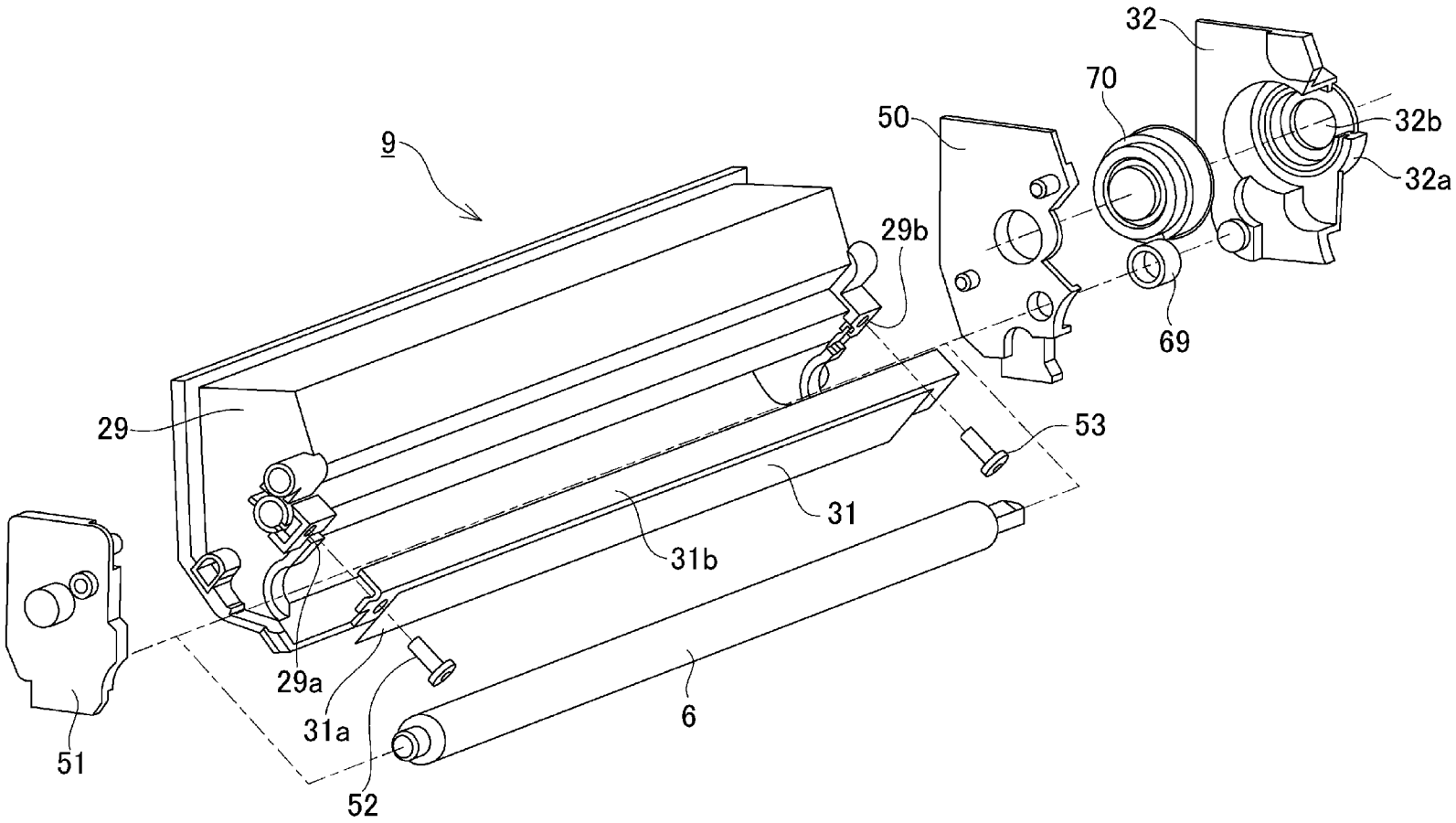
FIG. 5 is an exploded perspective view of a developing device as seen from the non-driving side in the embodiment of the present invention.

FIG. 5 is a perspective view of the developing device 9 as seen from the non-driving side in this embodiment of the present invention.

[Structure of Drum Unit]

Figure 4:
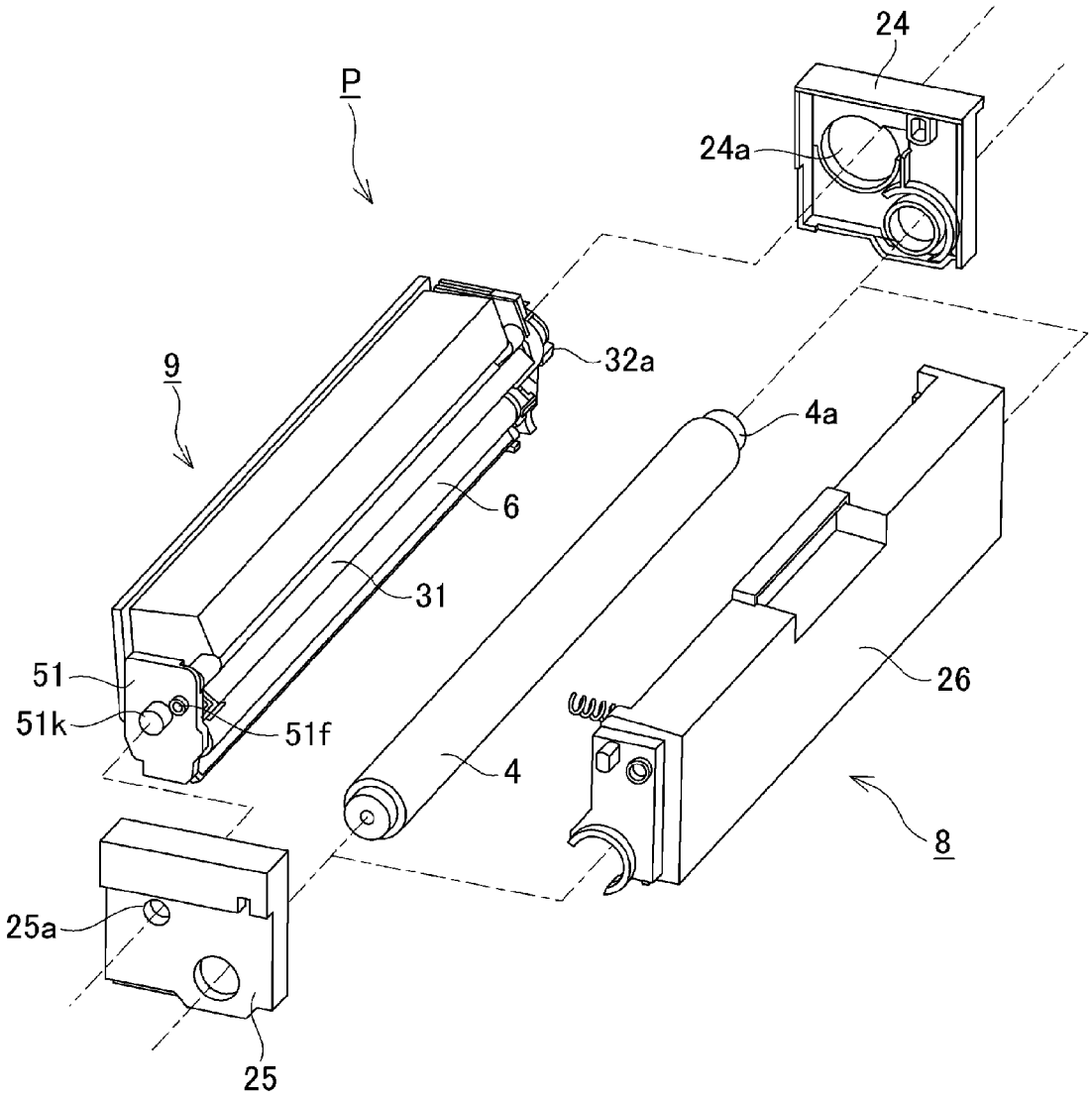
FIG. 4 is an exploded perspective view of the process cartridge as seen from a non-driving side in the embodiment of the present invention.

As shown in FIGS. 3 and 4, the drum unit 8 is constituted by the photosensitive drum 4, the charging means 5, the cleaning blade 7, a cleaning (device) frame 26, a residual developer accommodating portion 27 and cartridge cover members 24 and 25. The photosensitive drum 4 is rotatably supported by the driving side cartridge cover member 24 and the non-driving side cartridge cover member 25 which are provided at longitudinal end portions of the process cartridge P. Here, an axial direction of the photosensitive drum 4 is defined as a longitudinal direction. The cartridge cover members 24 and 25 are fixed to the cleaning frame 26 in end sides of the cleaning frame 26 with respect to the longitudinal direction. Further, as shown in FIG. 4, in one longitudinal end side of the photosensitive drum 4, a coupling 4*a* for transmitting a driving force to the photosensitive drum 4 is provided. The coupling member 4*a* is engaged with a coupling (not shown) as a drum drive outputting portion of the apparatus main assembly, so that the driving force of a driving motor (not shown) of the apparatus main assembly is transmitted to the photosensitive drum 4. The charging roller 5 is supported by the cleaning frame 26 so that it can be rotated by the rotation of the photosensitive drum 4 in contact with the photosensitive drum 4. Further, the cleaning blade 7 is fixed to the cleaning frame 26 with screws so that it is contacted to the peripheral surface of the photosensitive drum 4 at predetermined pressure. A transfer residual developer removed from the peripheral surface of the photosensitive drum 4 by the cleaning blade 7 is accommodated in a residual developer accommodated portion 27 in the cleaning frame 26. The cartridge cover members 24 and 25 are provided with supporting holes 24*a* and 25*a* for swingably (movably) supporting the developing unit 9. These supporting holes 24*a* and 25*a* are rotatably engaged with a cylindrical portion 32*a* of a driving side developing device cover member 32 (FIG. 5) of the developing unit 9 and a swing shaft 51*k* of a non-driving side bearing 51, respectively.

[Structure of Developing Unit]

FIG. 5 is a perspective view of the developing unit 9 as seen from the non-driving side in this embodiment. The developing unit 9 is, as shown in FIGS. 3 and 5, constituted by the developing roller 6, a developing blade 31, the developing device frame 29, bearings (driving side bearing 50 and non-driving side bearing 51 in FIG. 5), and the like member. The developing device frame 29 includes the developer accommodating portion 49 for accommodating the developer to be supplied to the developing roller 6 as the developer carrying member for carrying the developer. Further, the developing device frame 29 is provided with fixing holes (fixing hole 29*a* for the blade in the non-driving side and fixing hole 29*b* for the blade in the driving side) for fixing the developing blade 31 as a developer regulating member for regulating a layer thickness of the developer on the peripheral surface of the developing roller 6. The developing blade 31 is fixed to the developing device frame 29 by tightening screws 52 and 53 into the non-driving side blade fixing hole 29*a* and the driving side blade fixing hole 29*b*, respectively. The developing roller 6 is rotatably supported by the non-driving side bearing 51 and a driving side bearing 50. Each of the non-driving side bearing 51 and the driving side bearing 50 which support the developing roller 6 is positioned and fixed to the developing device frame 29. A positioning method and a fixing method will be described later.

At a longitudinal end of the developing roller 6 supported by the non-driving side bearing 51 and the driving side bearing 50, a developing roller gear 69 is provided. Further, to the driving side bearing 50, a developing device input gear 70 is provided so as to be connected with the developing roller gear 69. Further, the developing device cover member 32 is fixed to the outside portion of the driving side bearing 50 so as to cover the developing roller gear 69 and the developing device input gear 70. The developing device cover member 32 is provided with a cylindrical portion 32*a* in which the developing device input gear 70 is to be exposed through an opening 32*b* provided inside the cylindrical portion 32*a*. The develop input gear 70 has a constitution such that it is engaged with an unshown material coupling member when the process cartridge P is mounted in the apparatus main assembly 2, and the driving force from the driving motor (not shown) provided to the apparatus main assembly 2 is transmitted to the developing roller gear 69 via the developing device input gear 70.

[Positioning Between Developing Device Frame and Bearing]

Next, the positioning method and fixing method between the non-driving side bearing 51 and the developing device frame 29 will be described. The developing device frame 29 and the non-driving side bearing 51 are configured to form a filling space of a melted resin material at their boding portion and are connected with each other by a molded resin portion formed by solidification of the melted resin material injected into such a filling space. With reference to FIGS. 1, 6, 7 and 8, the positioning method and the fixing method will be described by using a first frame as the developing device frame 29 and a second frame as the non-driving side frame 51. Incidentally, also with respect to the positioning method and fixing method between the developing device frame 29 and the driving side bearing 50 (FIG. 5) in the driving side a similar constitution can be used.

Figure 6:
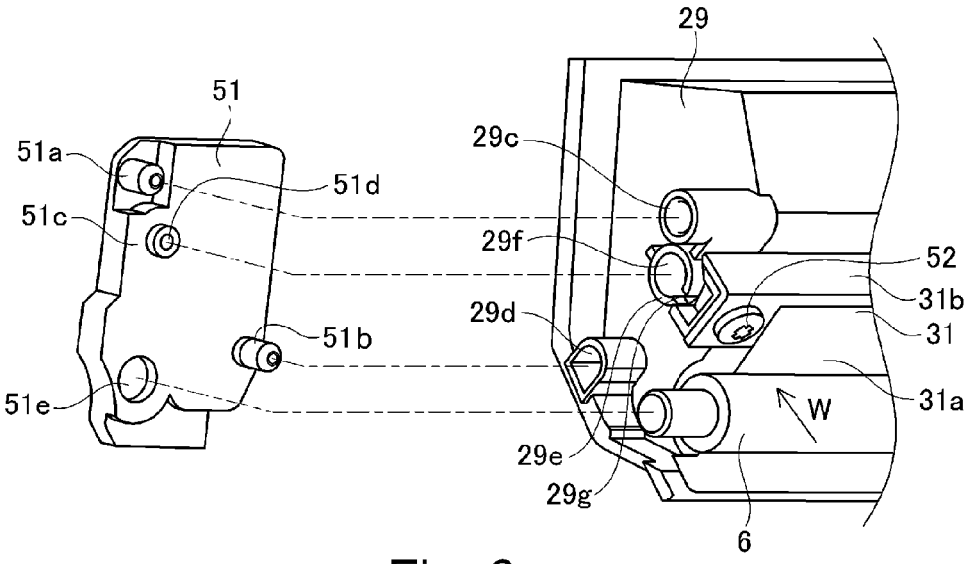
FIG. 6 is an illustration of positioning of the developing device frame and the non-driving side bearing in the embodiment of the present invention.

FIG. 6 is an enlarged view of the developing device frame 29 in the non-driving side during assembling of the non-driving side bearing 51. As shown in FIG. 6, the developing device frame 29 to which a base metal plate 31*b* of the developing blade 31 is to be fixed includes a positioning hole 29*c*, a rotation limiting hole 29*d* and a developing device frame side longitudinal abutment surface 29*e*. The developing blade 31 is the developer regulating member for regulating the developer layer on the developing roller. Further, the developing device frame 29 includes an injection recess 29*f* as an injecting portion where the melted resin material is injectable. At an entrance of the injection recess 29*f*, the developing device frame side longitudinal abutment surface 29*e* is cylindrically disposed, and a cut-away portion 29*g* formed by cutting away a part of the developing device frame side longitudinal abutment surface 29*e* is provided. Further, the non-driving side bearing 51 includes a positioning boss 51*a*, a rotation limiting boss 51*b*, and a bearing side longitudinal abutment surface 51*c*. The non-driving side bearing 51 further includes a supporting hole 51*e* and an inject path 51*d* for guiding the melted resin material.

When the non-driving side 51 is assembled with the developing device frame 29, the positioning hole 29*c* and the positioning boss 51*a* are engaged, and the rotation limiting hole 29*d* and the rotation limiting boss 51*b* are engaged. Further, the developing device frame side longitudinal abutment surface 29*e* and the bearing side longitudinal abutment surface 51*c* are intimately contacted, so that the non-driving side bearing 51 is positioned relative to the developing device frame 29. At this time, the developing roller 6 is supported by the supporting hole 51*e* of the non-driving side bearing 51, thus being positioned relative to the developing blade 31. Further, an axial direction of the injection path 51*d* of the non-driving side bearing 51 and an axial direction of the injection recess 29*f* of the developing device frame 29 are coincide (aligned) with each other.

[Fixing Method (Resin Bonding Method) Between Developing Device Frame and Bearing]

Next, a resin bonding method for fixing the non-driving side bearing 51 to the developing device frame 29 by the melted resin material (melted resin material 54) will be described.

Figure 1:
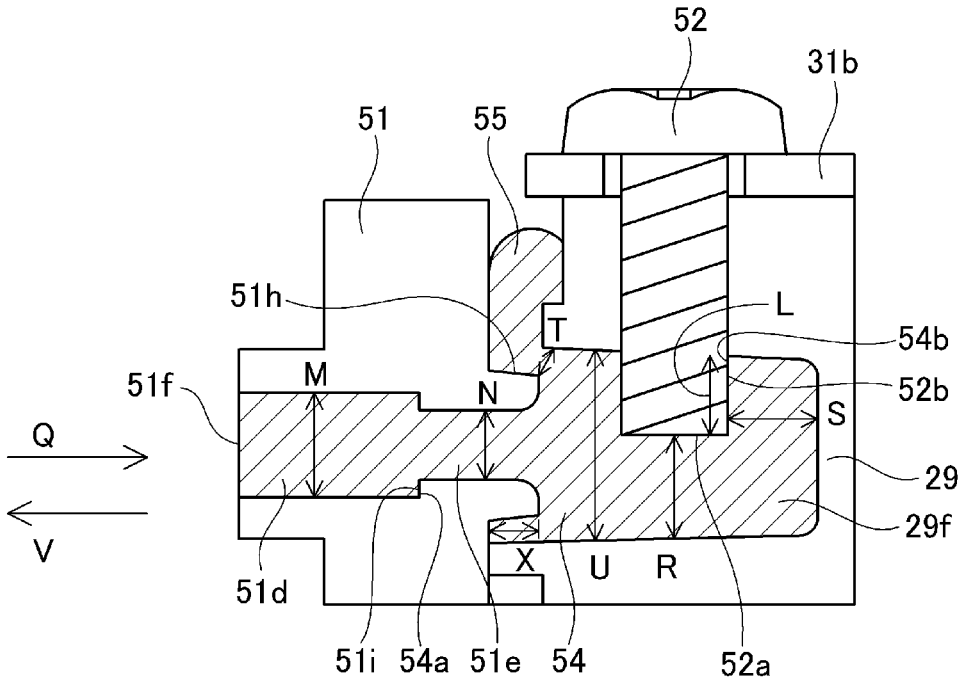
FIG. 1 is a schematic sectional view for illustrating a fixing method of a developing device frame and a non-driving side bearing in an embodiment of the present invention.
Figure 7:
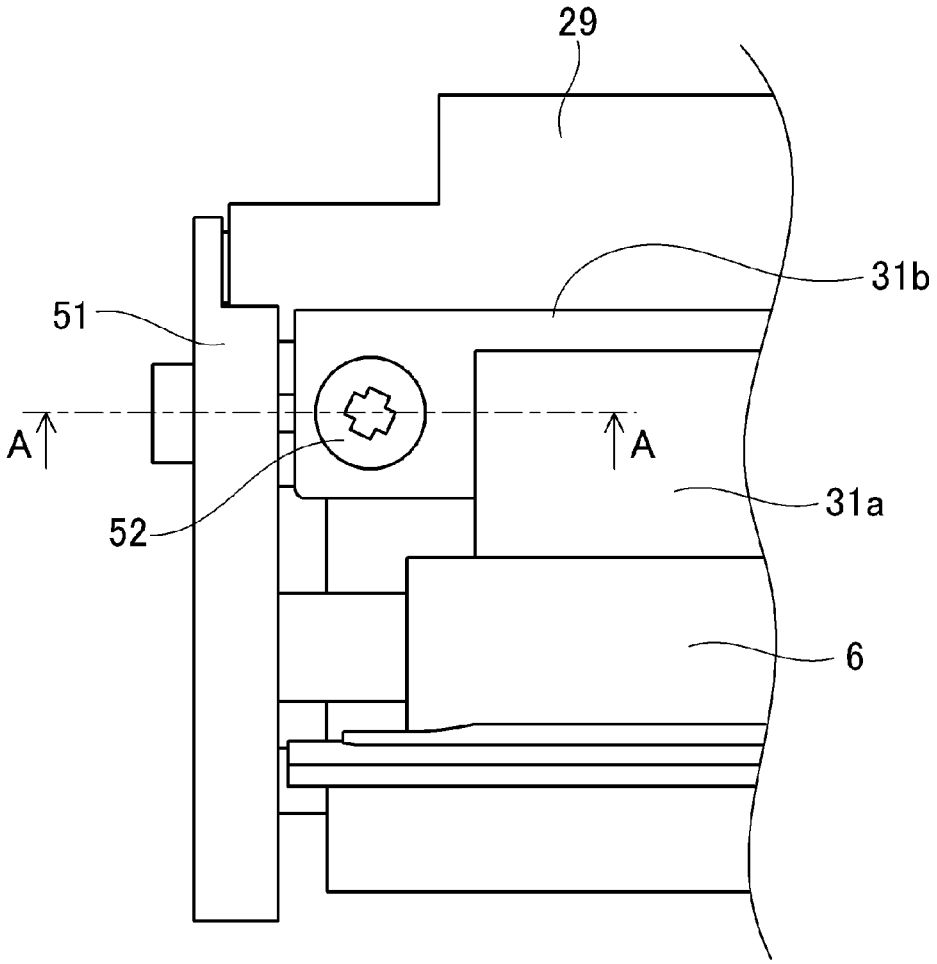
FIG. 7 is an enlarged view of the developing device frame as seen from a front side of a developing blade in embodiment of the present invention.

FIG. 7 is an enlarged view of the developing device frame 29 as seen in a front surface direction (arrow W direction in FIG. 6) of the developing blade 31. Parts (a) and (b) of FIG. 8 are sectional views of a resin material injection path in the developing device frame 29 and the non-driving side bearing 51 taken long A-A line in FIG. 7, in which (a) of FIG. 8 is the sectional view before assembling between the developing blade 31 and the non-driving side bearing 51, and (b) of FIG. 8 is the sectional view after the assembling between the developing blade 31 and the non-driving side bearing 51. FIG. 1 is a sectional view of the non-driving side bearing 51 and the developing device frame 29, taken along A-A line in FIG. 7, in a state in which the melted resin material for fixing is injected (in a state in which the molded resin portion 54 is formed).

As shown in (a) of FIG. 8, the non-driving side bearing 51 includes the injection path 51*d* for guiding the melted resin material in an arrow Q direction. With respect to the arrow Q direction, a diameter M of the inject path 51*d* at an upstream flow passage is larger than a diameter N of the inject path 51*d* at a downstream flow passage. Further, the non-driving side bearing 51 includes a second limiting (regulating) portion 51*i* for limiting (regulating) the melted resin material injected into the injection path 51*d*. The second limiting portion 51*i* is a surface which will face the melted resin material injected in an injection direction (arrow Q direction in FIG. 8).

That is, the injection path 51*d* includes a portion where a space becomes narrow with respect to a melted resin material guiding direction, and this portion constitutes the second limiting portion 51*i* for limiting movement of the non-driving side bearing 51 relative to the molded resin portion 54 after the solidification of the melted resin material.

The developing device frame 29 includes the injection recess 29*f* for receiving the melted resin material injected in the arrow Q direction (a) of FIG. 8. Further, at a part of the inner surface of the injection recess 29*f*, the cut-away portion 29*g* is provided. Further, the developing device frame 29 is provided with a non-driving side blade fixing hole (through hole) 29*a* extending in an arrow J direction crossing the melted resin material injection direction (arrow Q direction in (a) of FIG. 8). The non-driving side blade fixing hole 29*a* penetrates through (opens to) the injection recess 29*f*. Into the non-driving side blade fixing hole 29*a*, as shown in (b) of FIG. 8, the screw 52 as a fixing member for fixing the base metal plate 31*b* of the developing blade 31 to the developing device frame 29 is to be injected. When the screw 52 is injected into the non-driving side blade fixing hole 29*a* to fix the base metal plate 31*b* of the developing blade 31 to the developing device frame 29, the screw 52 is projected into the inject recess 29*f* by a length L. This projected portion occupies a part of an inner portion of the injection recess 29*f* with a width W to leave a portion, with a width R narrower than the width W, formed between an end surface (bottom) 52*a* of the screw 52 and a lower inner surface of the injection recess 29*f*. When the melted resin material (not shown) is injected into the injection recess 29*f* after the screw 52 is fixed to the developing device frame 29 as described above, the projected portion of the screw 52 in the injection recess 29*f* constitutes a first limiting (regulating) portion 52*b* for limiting (regulating) the injected melted resin material (not shown). The first limiting portion 52*b* is, after the melted resin material is solidified, in an engaged with the molded resin portion 54 so as to limit the molded resin portion from being demounted (disconnected) from the developing device frame 29.

As described above, when the non-driving side bearing 51 is positioned relative to the developing device frame 29, a space is formed (defined) by the developing device frame 29 and the non-driving side bearing 51. Specifically, the space is formed (defined) by the injection recess 29 and the injection path 51. An axial direction of the injection path 51*d* and an axial direction of the injection recess 29*f* of the developing device frame 29 are coincide with each other, so that the injection path 51*d* and the injection recess 29*f* are aligned in a line from an upstream side of the arrow Q direction. At this time, a resin material outlet (exit) 51*g* of the injection path

51*d* in the downstream side of the arrow Q direction is located toward the inside of the injection recess 29*f* by a depth X form a contact surface between the developing device frame side longitudinal abutment surface 29*e* and the non-driving side bearing longitudinal abutment surface 51*c* with respect to the arrow Q direction. Further, a distance T between an upper inner surface of the injection recess 29*f* and an outer portion 51*h*, of the resin material outlet 51*g*, as an outer wall portion of the resin material outlet 51*g* is set so as to be smaller than the width R between the end surface 52*a* of the screw 52 and the lower inner surface of the injection recess 29*f* and a width surface between the first limiting portion 52*b* of the screw 52 and a right-hand inner surface of the injection recess 29*f*.

As shown in FIG. 1, when the melted resin material is injected in the arrow Q direction from the resin material injection port (entrance) 51*f*, of the injection path 51*d*, in the upstream side with respect to the arrow Q direction after the developing blade 31 is fixed to the developing device frame 29 with the screw 52, the melted resin material passes through the injection path 51*d*. Then, the melted resin material further passes through the portion (width R portion) between the end surface 52*a* of the screw 52 and the lower inner surface of the injection recess 29*f* and the portion (width S portion) between the first limiting portion 52*b* of the screw 52, thus filling the injection path 51*d* and the injection recess 29*f*. At this time, in the injection path 51*d*, the second limiting portion 51*i* and the melted resin material are adhesively bonded to each other, and in the injection recess 29*f*, the first limiting portion 52*b* and the melted resin material are adhesively bonded to each other. Further, the melted resin material passes through the portion (width T portion) between the outer portion 51*h* of the resin material outlet and the upper inner surface of the injection recess 29*f* to reach a buffer portion 55 provided, from the cut-away portion 29*g*, between the developing device frame 29 and the non-driving side bearing 51, thus filling a part of the buffer portion 55. In order to fill the injection path 51*d* and the injection recess 29*f* with the melted resin material with reliability even in the case where there are a variable in injection amount of the melted resin material and a variation in molding of the injection path 51*d* and the injection recess 29*f*, the melted resin material is injected in a large amount. That is, into the injection path 51*d* and the injection recess 29*f*, the melted resin material is caused to flow in an amount more than an amount in which a maximum volume of the injection path 51*d* and the injection recess 29*f*. The buffer portion 55 have a volume in which an excessive melted resin material is accommodated, so that the melted resin material cannot be leaked out of the buffer portion 55. Further, the portion (width R portion) bearing the end surface 52*a* of the screw 52 and the lower inner surface of the injection recess 29*f* and the portion (width S portion) between the first limiting portion 52*b* of the screw 52 and the right-hand inner surface of the injection recess 29*f* are broader than the portion (width T portion) between the outer portion 51*h* of the resin material outlet and the upper inner surface of the injection recess 29*f*. As a result, the melted resin material flows into the width R portion and the width S portion before flows into the width T portion. Therefore, the melted resin material does not fill the buffer portion 55 by passing through the width T portion before it passes through the width R portion and the width S portion to fill the injection recess 29*f*. Further, the developing device frame side longitudinal abutment surface 29*e* and the non-driving side bearing abutment surface 52*c* are contacted and therefore the melted resin material does not leak out to another portion.

When the melted resin material filling the inject path 51*d* and the injection recess 29*f* is cooled and solidified to form the molded resin portion 54, the second limiting portion 51*i* and a first portion-to-be-locked 54*a* of the molded resin portion 54 are adhesively contacted, so that movement of the non-driving side bearing 51 relative to the developing device frame 29 in an arrow V direction in FIG. 1 is limited. Similarly, the first limiting portion 52*b* and a second portion-to-be-locked 54*b* of the molded resin portion 54 are adhesively contacted, so that movement of the developing device frame 29 relative to the molded resin portion 54 in an arrow Q direction in FIG. 1 is limited. Therefore, the non-driving side bearing 51 cannot be moved relative to the developing device frame 29 in the arrow V direction in FIG. 1, thus being connected to the developing device frame 29.

A resin material used as the melted resin material for forming the molded resin portion 54 is polyacetal (POM: polyoxymethylene), and the melted resin material is melted at about 190° C. to about 210° C. and is solidified when cooled, so that the molded resin portion 54 is formed. Further, a material for the developing device frame 29 as the first frame and the non-driving side bearing 51 as the second frame is polystyrene (HIPS: high-impact polystyrene). By the developing device frame 29, the non-driving side bearing 51 and the molded resin portion 54 which are formed of these resin materials, a resin-bonded member in the present invention is constituted. Polystyrene (HIPS) has low compatibility with polyacetal (POM) as the melted resin material for forming the molded resin portion 54 and therefore the materials are not mutually dissolved between the melted resin material and the injection recess 29*f*, so that a bonding force is not readily generated. Further, the melted resin material is injected so that a resin temperature thereof is lower than a melting portion of polystyrene (HIPS) for forming the injection recess 29*f* of the developing device frame 29 when the melted resin material reaches the inner surface of the injection recess 29*f* of the developing device frame 29*f*. Therefore, the inner surface of the injection recess 29*f* is not dissolved by heat of the melted resin material and therefore the materials are not mutually dissolved between the molded resin portion 54 and the injection recess 29*f* of the developing device frame 29, so that a bonding force is not readily generated. Thus, the bonding force is not readily generated between the molded resin portion 54 and the injection recess 29*f* of the developing device frame 29 and therefore these portions are freely separable. As described above, the connection between the non-driving side 51 and the developing device frame 29 can be maintained, without being separated, by the second limiting portion 51*i* and the first limiting portion 52*b*. In this embodiment, polyacetal (POM) is used for the molded resin portion 54, and polystyrene (HIPS) is used for the developing device frame 29 and the non-driving side bearing 51, but other resin materials may also be used when materials used for the molded resin portion 54 and the developing device frame 29 have low compatibility with each other and thus are freely separable from each other. Further, in the case where the material used for the molded resin portion 54 and the material used for the first and second frames have mutual solubility (compatibility), when the constitution of the present invention is employed, the first and second frames can be fixed more firmly. The present invention limited to the above constitution when at least a portion, of the developing device frame 29, contacting the molded resin portion 54 is constituted so as to have a melting point higher than the temperature of the injected melted resin material.

As described above, the molded resin portion 54 is intimately contacted to the screw 52 for fixing the developing blade 31 to the developing device frame 29, so that the non-driving side bearing 51 is fixed to the developing device frame 29. In this method, different from the conventional method, there is no need to separately provide the space (screw fixing space or conventional resin bonding space) for permitting fixing of the non-driving side bearing 51 to the developing device frame 29 and the space for permitting fixing of the developing blade 31 to the developing device frame 29. Therefore, it is possible to provide a smaller-sized developing device or process cartridge.

Further, in the drum unit 8, the above constitution can be realized by using the cleaning frame 26 as the first frame, the cartridge cover members 24 and 25 as the second developing roller and the cleaning blade 7 as the cleaning member in place of the developing blade. Therefore, the above constitution is not limited to that for fixing the developing device frame 29 and the non-driving side bearing 51.

Incidentally, the drum unit 8 can employ a similar constitution by using the cleaning frame 26 as the first frame and the cartridge cover members 24 and 25 as the second frame and therefore the constitution in the present invention is not limited to that for fixing the developing device frame 29 and the non-driving side bearing 51.

[Developing Unit Disassembling Method]

Next, with reference to FIGS. 9 and 10, a method for disassembling the developing blade 31, the developing roller 6 and the non-driving side bearing 51 form the developing device frame 29 will be described. In the following, description will be made by taking, as an example, the developing device frame 29 as the first frame and the non-driving side bearing 51 as the second frame but even when the developing device frame 29 is used as the first frame and the driving side bearing 52 is used as the second frame, these members can be disassembled by a similar disassembling method. Parts (a) and (b) of FIG. 9 are sectional views of the developing device frame 19 and the melted resin material injection portion of the non-driving side bearing 51 taken along A-A line in FIG. 7 when the screw 52 is removed from the developing device frame, in which (a) of FIG. 9 shows a state before the non-driving side bearing 51 is separated from the developing device frame 29, and (b) of FIG. 9 shows a state after the non-driving side 51 is separated from the non-driving side bearing 51. FIG. 10 is a perspective view of the developing unit 9 during disassembling. As shown in FIGS. 9 and 10, when the screw 52 is disconnected form the non-driving side blade fixing hole 29*a* in the arrow Y direction, in the figures, which is the axial direction of the non-driving side blade fixing hole 29*a*, the base metal plate 31*b* is disconnected from the developing device frame 29, so that the developing blade 31 is demounted from the developing device frame 29. Then, when the non-driving side bearing 51 is moved in the arrow V direction in the figures, there is no second limiting surface 52*b* which has acted on the second portion-to-be-locked 54*b* of the molded resin portion 54 since the screw 52 has already been disconnected, and therefore the non-driving side bearing 51 is demounted from the developing device frame 29. At this time, the molded resin portion 54 and the injection recess 29*f* have low compatibility and are freely separable from each other, so that the molded resin portion 54 and the injection recess 29*f* are not adhesively fixed. Further, the first limiting surface 51*i* and the first portion-to-be-locked 54*a* of the molded resin portion 54 are adhesively contacted to each other, and therefore the molded resin portion 54 is demounted together with the non-driving side bearing 51 from the developing device frame 29. Then, the developing roller 6 supported by the non-driving side bearing 51 is demounted from the non-driving side bearing 51.

As described above, in this embodiment, the connection between the developing device frame 29 and the non-driving side bearing 51 is eliminated by a single step such that the screw 52 which has fixed the developing blade 31 to the developing device frame 29 is removed. That is, the limitation by the first limiting portion 52*b* of the screw 52 is eliminated to enable separation of the molded resin portion 54 from the developing device frame 29, so that the non-driving side bearing 51 becomes separable from the developing device frame 29. As a result, the developing blade 31, the non-driving side bearing 51 and the developing roller 6 can be concurrently disassembled from the developing device frame 29. Therefore, the conventional two steps consisting of a step of demounting the non-driving side bearing 51 from the developing device frame 29 and a step of demounting the developing blade 31 from the developing device frame 29 can be reduced to the single step, so that a disassembling property of the process cartridge can be improved.

Incidentally, also in the drum unit 8, its constituent members can be disassembled by a similar disassembling method in which the cleaning container 26 is used as the first frame and the cartridge cover members 24 and 25 are used as the second frame. That is, the above constitution is not limited to that for disassembling the developing device frame 29 and the non-driving side bearing 51.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 283250/2011 filed Dec. 26, 2011, and 053586/2012 filed Mar. 9, 2012, which are hereby incorporated by reference.

What is claimed is:

1. A unit for use with an image forming apparatus, said unit comprising:

a first frame;

a screw for fixing a member-to-be-fixed to said first frame;

a second frame mounted to said first frame; and a molded resin portion formed by injecting a melted resin material into a space defined by said first frame and said second frame, wherein said molded resin portion is engaged with said screw projected into the space and is engaged with a limiting portion provided on said second frame to connect said first frame and said second frame.

2. A unit according to claim 1, wherein, when said screw is disengaged from said first frame to separate said first and second frames, said limiting portion limits disengagement of said molded resin portion from said second frame and permits separation of said molded resin portion from said first frame.

3. A unit according to claim 1, wherein said second frame includes an injection port through which the melted resin material is injected into the space.

4. A unit according to claim 1, wherein said screw is mounted in a through hole connected to the space, and wherein said through hole extends in a direction crossing an injection direction in which the melted resin material is injected.

5. A unit according to claim 1, further comprising a buffer portion partly filled with the molded resin material between said first and second frames.

6. A unit according to claim 1, wherein said unit is a developing unit for use with an image forming apparatus including a developer carrying member for carrying a developer, and wherein said member-to-be-fixed is a blade for regulating an amount of a developer to be carried on the developer carrying member.

7. A process cartridge detachably mountable to a main assembly of an image forming apparatus, said process cartridge comprising:

a photosensitive drum; and a developing unit as recited in claim 6.

8. A unit according to claim 1, wherein said unit is a drum unit for use with an image forming apparatus including a photosensitive drum, and wherein said member-to-be-fixed is a blade for removing a developer from the photosensitive drum.

9. A process cartridge detachably mountable to a main assembly of an image forming apparatus, said process cartridge comprising a drum unit as recited in claim 8.

* * * * *